US009266163B2

(12) United States Patent
Tatarczyk

(10) Patent No.: US 9,266,163 B2
(45) Date of Patent: Feb. 23, 2016

(54) PUNCHING SHEET METAL

(75) Inventor: Alexander Tatarczyk, Seltingen-Oberflacht (DE)

(73) Assignee: TRUMF Werkzeugmaschinen GmbH + Co. KG, Ditzingen (DE)

( * ) Notice: Subject to any disclaimer, the term of this patent is extended or adjusted under 35 U.S.C. 154(b) by 693 days.

(21) Appl. No.: 13/493,506

(22) Filed: Jun. 11, 2012

(65) Prior Publication Data

US 2012/0312064 A1 Dec. 13, 2012

(30) Foreign Application Priority Data

Jun. 10, 2011 (EP) ..... 11169497

(51) Int. Cl.
*B21D 28/34* (2006.01)
*B21D 28/16* (2006.01)
*B21D 28/24* (2006.01)

(52) U.S. Cl.
CPC ..... *B21D 28/343* (2013.01); *B21D 28/16* (2013.01); *B21D 28/24* (2013.01)

(58) Field of Classification Search
CPC ..... B21D 28/34; B21D 28/28; B21D 28/343; B26F 1/14
USPC ..... 83/686, 698.91, 55, 684, 698.71; 72/326–337
See application file for complete search history.

(56) References Cited

U.S. PATENT DOCUMENTS

| | | | | |
|---|---|---|---|---|
| 4,526,077 A | | 7/1985 | DeGuvera | |
| 4,869,141 A | * | 9/1989 | Klingel | 83/49 |
| 5,746,104 A | | 5/1998 | Russell et al. | |
| 5,992,280 A | | 11/1999 | Oishi et al. | |

FOREIGN PATENT DOCUMENTS

| | | | | |
|---|---|---|---|---|
| CN | 102363178 A | | 2/2012 | |
| GB | 2255304 A | | 11/1992 | |
| JP | 59174233 A | | 10/1984 | |
| JP | 08-10865 | * | 8/1996 | B21D 28/00 |
| JP | 2005193251 A | | 7/2005 | |
| JP | 2005324236 A | | 11/2005 | |
| SU | 442872 | | 9/1974 | |

OTHER PUBLICATIONS

JP2005193251 translation; Nukaga Tadashi, Jul. 21, 2005.*
JP08-10865 english translation; Hosoya Yukijiro Aug. 1996.*
European Search Report from corresponding European Application No. 11 16 9497, mailed Oct. 27, 2011, 7 pages.

* cited by examiner

*Primary Examiner* — Laura M Lee
(74) *Attorney, Agent, or Firm* — Fish & Richardson P.C.

(57) ABSTRACT

A method for punching and straightening sheet metal in a punching machine includes the steps that a die is accommodated in a first tool holder of a punching machine, an upper tool part with a stamp is accommodated in a second tool holder, and a sheet metal is positioned between the stamp and the die at a location to be machined. The stamp comprises an end face at an end opposite to an accommodated end of the upper tool part, wherein a bevel has an angle and a height extending from a rim of the face to the end face. Then, a punching operation is performed by the stamp, wherein radial forces are simultaneously applied to the sheet metal during cutting so that an evenness of the sheet metal is maintained even at high grades of punching.

7 Claims, 4 Drawing Sheets

PUNCHING SHEET METAL

CROSS-REFERENCE TO RELATED APPLICATION

This application claims priority under 35 U.S.C. §119(a) to EP 11 169 497.2, filed on Jun. 10, 2011, the entire contents of which are incorporated herein by reference.

TECHNICAL FIELD

The invention relates to punching sheet metal.

BACKGROUND

When punching sheet metal in punching machines, orifices are punched in the sheet metal. Therefore, the sheet metal is pushed in an orifice of a die by means of a stamp. The contour of the stamp corresponds to the contour of the die. In order to create a clearance, the orifice of the die is circumferentially larger than the dimensions of the stamp by a few decimillimeters. Thereby, in the initial phase of the stamping operation, the sheet metal is pushed into the die so that it deforms and tensile stress occurs at the upper surface of the sheet metal. Further, when viewed in cross-section, the upper region of a punching is cut or sheered by sheering forces between the stamp and the die and, finally, the lower portion breaks out due to the reduced carrying cross-section. The tensile stress initially brought in by the deformation is maintained in the sheet metal so that the whole metal sheet or individual portions of the sheet metal are deformed dependent on the size and the number of the punchings. The outer regions of the metal sheet or of the individual portions of the sheet metal except the regions where the sheet metal is clamped fixedly are upwardly bent by the tensile stress. This leads to inaccuracies during further processing and to increased wear of the tool.

The situation can be improved by specifically grinded dies and by the use of an active stripper forcing the sheet metal downward against the die, however, such possibilities are restricted in the case of elongated hole-like tools where no convexity is possible on the die. Furthermore, grinding in a convex manner is only possible in specific cylindrical grinder machines which render the production elaborate and costly. In addition to that, the use of the die grinded in the convex manner is only possible up to a certain grade of punching.

Furthermore, there is the possibility to machine the sheet metal on specific straightening machines in order to restore an evenness of the sheet metals. In these straightening machines, the bent sheet metal is rendered strainless by repeatedly reshaping the sheet metal by means of an arrangement of multiple rollers. Thereby, the sheet is bent in the opposite direction during the movement across the rollers again and again. By such multiple bending of the sheet metal, stresses are removed therefrom and an even, strain-less sheet metal can be obtained. However, this processing is costly because an additional machine and further process steps are necessary. Moreover, this processing is not possible on sheet metals on which remodeling has already been performed in the punching machine.

SUMMARY

It is an object of the invention to correct deformation of a metal sheet during punching and to maintain an even shape of the sheet metal.

This object and further developments may be achieved by the various embodiments described herein.

In one embodiment, a die and a stamp complementary to the die are accommodated, wherein the stamp comprises an end face and a bevel, wherein a predetermined height of the bevel lies circumferentially along the rim of the end face adjacent to the end face, so that the evenness of the sheet metal may be maintained.

By providing the bevel, the clearance between the stamp and the die is larger than with a conventional stamp whereby a bend radius of the orifice to be punched becomes larger and additional stresses are brought into the sheet metal when the stamp impinges on the sheet metal. Due to the bevel, radial forces are brought into the sheet metal when the stamp penetrates into the sheet metal. The radial forces are suitable for counteracting the stresses in the sheet metal, in particular, in perforated sheet metal plates with a high grade of punching.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
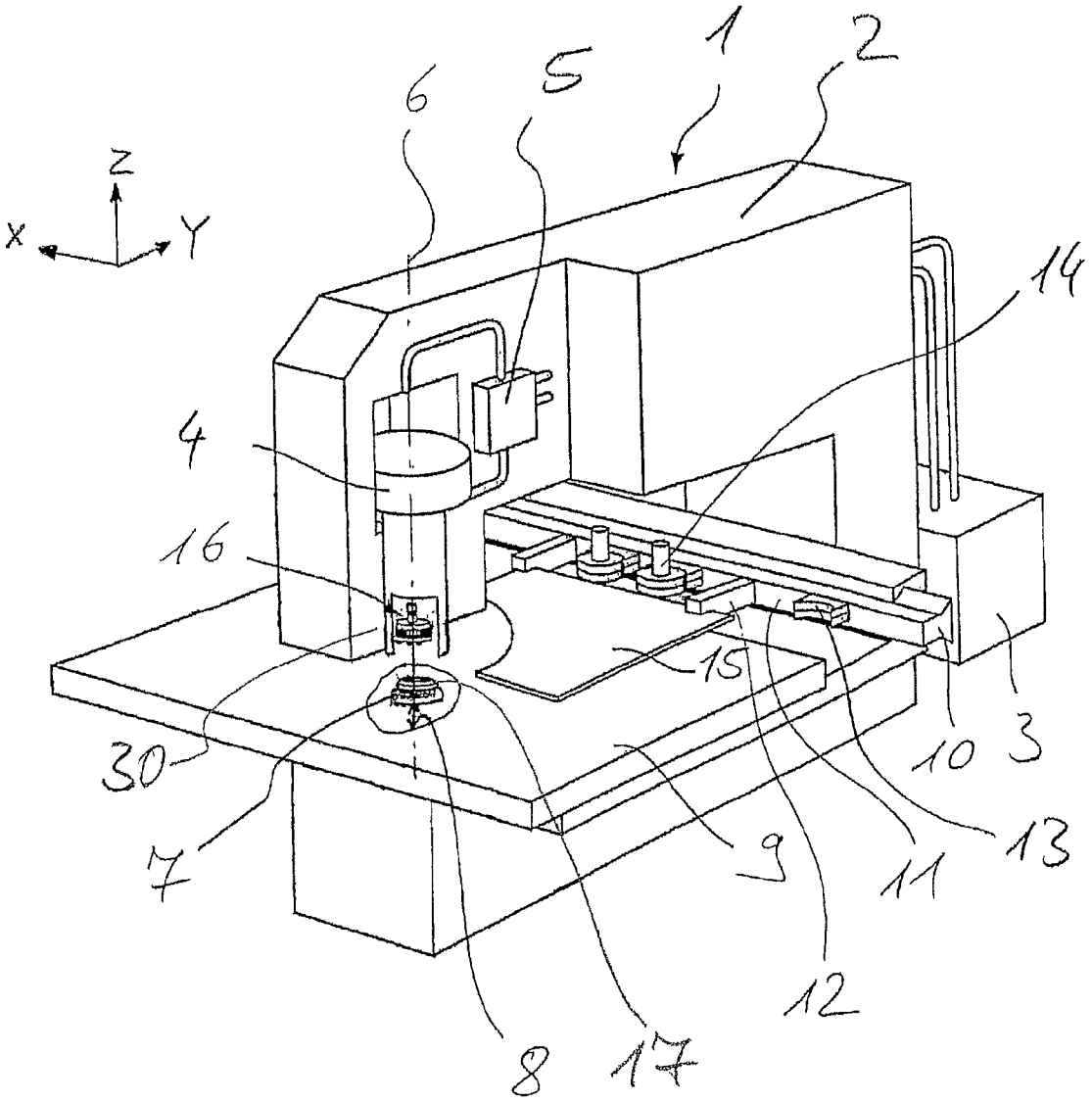
FIG. 1 shows a punching machine.

In FIG. 1, a punching machine 1 with a punching tool according to the invention is illustrated. A C-frame 2 is a substantial component to the punching machine 1. The C-frame 2 is made of a torsionally stiff welded construction of steel. Alternatively, the frame may be constructed in another manner.

At the rear end of the C-frame 2, a hydraulic power unit 3 that hydraulically drives a plunger 4 by means of a plunger controller 5 is provided.

The punching machine comprises an axis 6 constituting the center axis of a lower first tool holder 7 and of the plunger 4 with the upper second tool holder 30. The first tool holder 7 is provided on the lower inner side of the C-frame 2 for accommodating a lower tool part 17 of the punching tool. The first tool holder 7 is rotatable by means of a rotary drive (not shown) and it is lockable in any arbitrary angular position. Furthermore, the first tool holder 7 comprises a drive 8 that moves the first tool holder 7 upwardly and downwardly along the axis 6. The drive 8 may be controlled such that it may stop at any arbitrary position within its stroke and, then, it may move forward or backward.

The plunger 4 is provided on the upper inner side of the C-frame 2. The plunger 4 with the second tool holder 30 accommodates an upper tool part 16 of the punching tool in a form-fit and backlash-free manner. The plunger 4 is also rotatable and it may also be locked in any arbitrary angular position. Therefore, a second rotary drive (not shown) exists.

Controlled by the plunger controller 5, the plunger 4 may also be stopped at any arbitrary position within its stroke along the axis 6 and may subsequently be moved further upwardly or downwardly.

The actuators, such as the rotary drives, the plunger controller 5, and the drive 8 of the first tool holder 7 are controlled by a machine control device (not shown) provided in a separate electric cabinet (not shown). Furthermore, the drives for moving a sheet metal plate 15 and actuators for specific functions are controlled by a machine control device. The control device comprises a keyboard and a monitor as input and output means. The control functions are performed by means of micro controllers. Machining programs and operation parameters are stored in a storing portion of the control device.

At the lower inner side of the C-frame 2, a table 9 comprising a cross rail 10 with a tool magazine 11 is arranged. At the cross rail 10, clamping claws 12 for adhering the sheet metal 15 are arranged. The clamping claws 12 may be fixed at suitable position on the cross rail and they may be relocated such that the sheet metal 15 is held safely but the sheet metal 15 is not gripped at a location to be machined. In the tool magazine 11, multiple (here: three) tool holders 13 exist for multiple (here: two) punching tools 14.

In operation, the table 9, together with the cross rail 10 at which the clamping claws 12 hold the sheet metal fixed relative to the cross rail 10, move in a Y-direction in a programmed position and the cross rail 10 moves in an X-direction in the programmed position whereby the sheet metal 15 slides over the table 9. Then, the plunger 4 carries out a punching stroke. Subsequently, the next punching position is approached according to the same principle.

Figure 2:
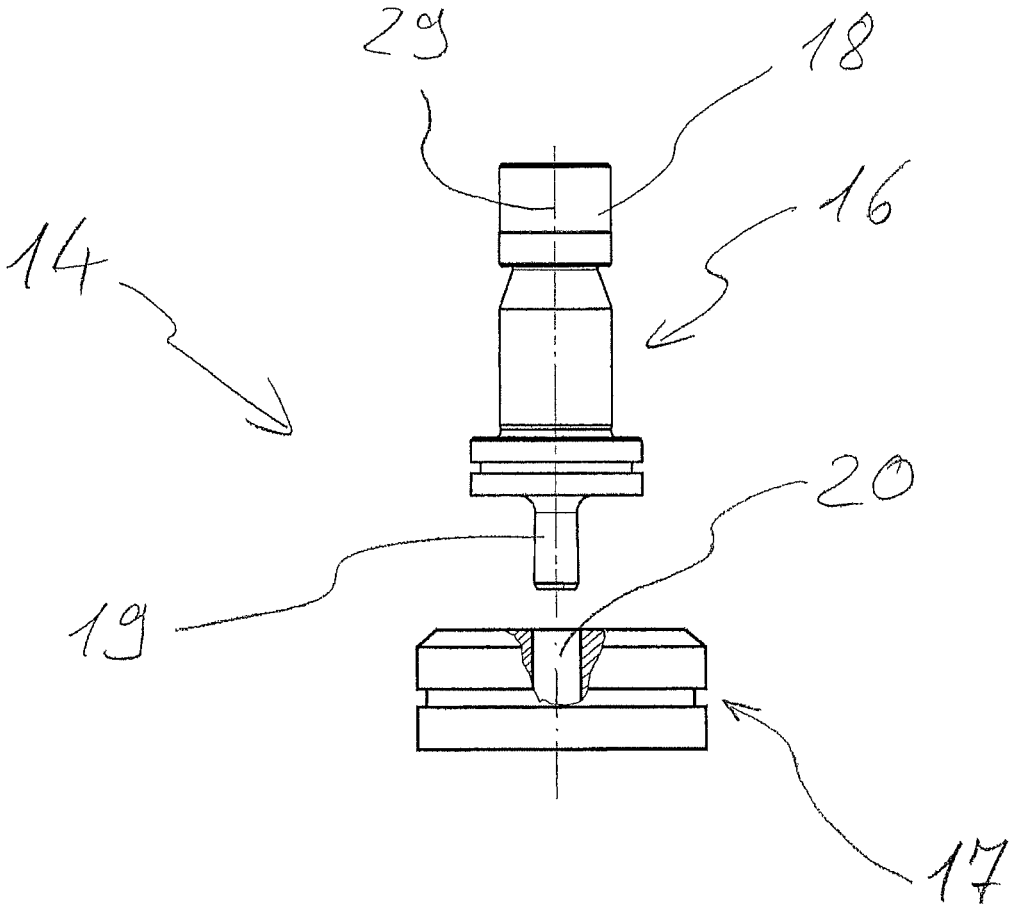
FIG. 2 shows a punching tool of the punching machine of FIG. 1.

In FIG. 2, a punching tool 14 comprising a die 17 as a lower tool part and the upper tool part 16 is shown. The upper tool part 16 comprises a shaft 18 formed such that it may be accommodated in a form-fit and backlash-free manner in the second tool holder 30. At the end of the upper tool part 16, opposite to the shaft 18, the upper tool part 16 comprises a stamp 19.

The die 17 is formed such that it may be accommodated in a form-fit and backlash-free manner in the lower, first tool holder 7. The die 17 comprises an orifice 20 formed such that a desired punching may be punched out of the sheet metal 15. The orifice 20 is complementary to the stamp 19.

The upper tool part 16 and the die 17 have a common axis 29.

Between the stamp 19 and the orifice 20, a gap of a few decimillimeters, which is denoted as a clearance, is provided radially circumferentially.

In an alternative embodiment, the upper tool part 16 may be accommodated in the lower first tool holder 7 and the die 17 may be accommodated in the upper second tool holder 30.

Figure 3A:
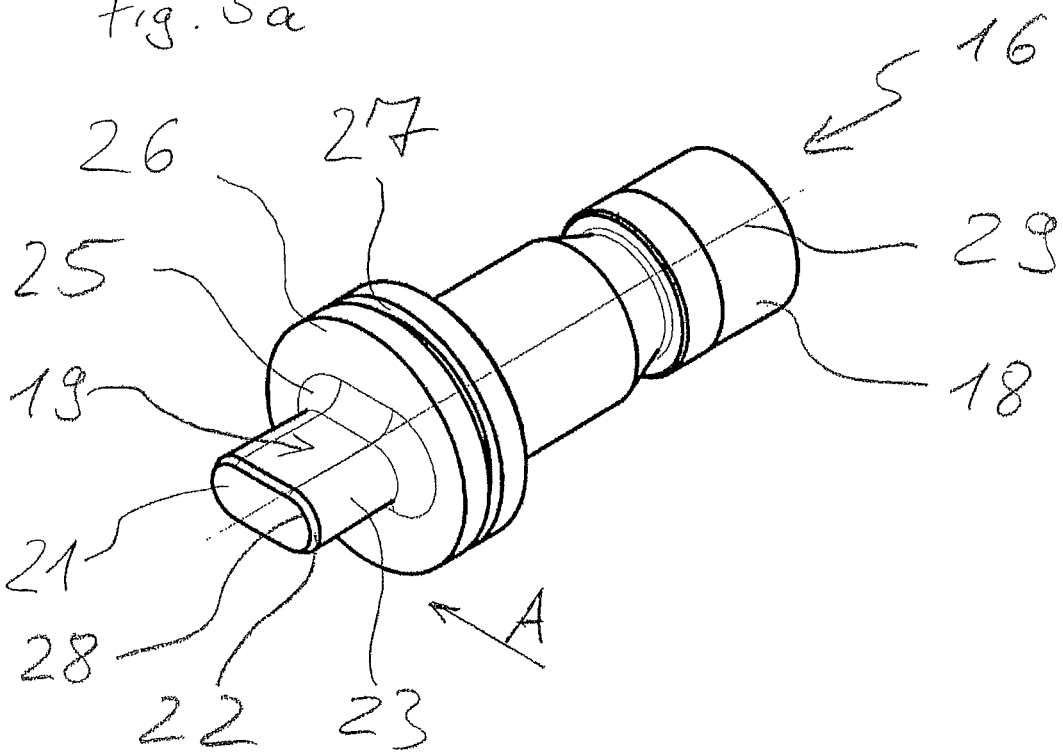
FIG. 3*a* shows a stamp of the punching tool of FIG. 2.
Figure 3B:
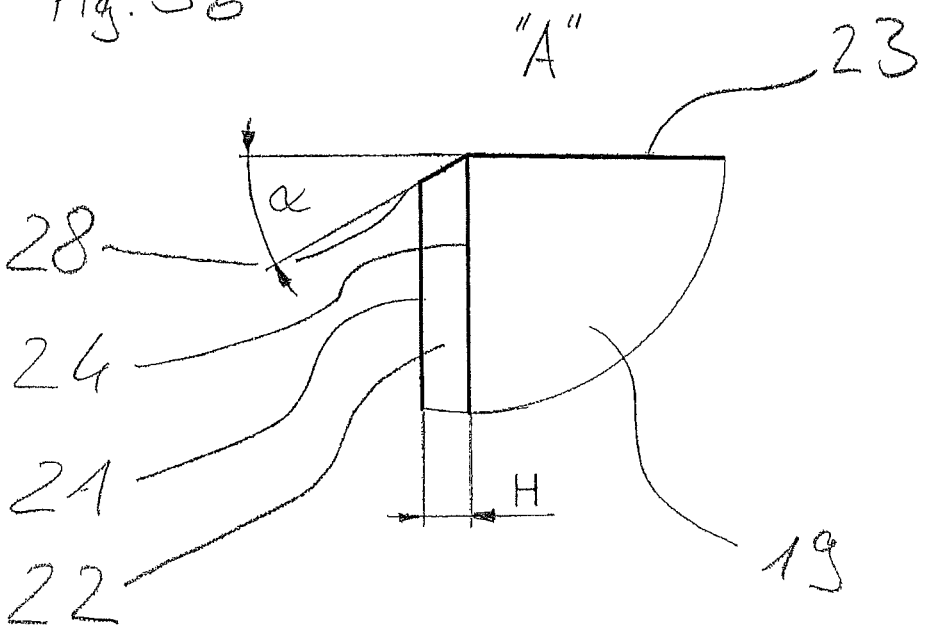
FIG. 3*b* is an enlarged view of a portion of the end of the stamp of FIG. 3*a*, in side view.

FIG. 3*a* shows a perspective view of the upper tool part 16 and FIG. 3*b* is an enlarged view of a portion of the end of the stamp 19 viewed from the viewing direction A. At an end opposite to the shaft 18, the upper tool part 16 comprises an end face 21. Adjacent to the end face 21, a bevel 22 is provided circumferentially along a rim 28. Subsequent to the bevel 22, the stamp 19 comprises a side face 23. Between the side face 23 and the bevel 22, an angle α of the bevel 22 is formed. The distance between the end face 21 and an edge 24 forming the transition between the bevel 22 and the side face 23 define a height H of the bevel 22. Subsequent to the stamp 19 in a direction toward the shaft 18, a collar is provided, wherein, between the stamp 19 and the collar 26, a transition 25 having a radius is formed. The collar 26 comprises a recess 27. The design of the collar 26 is chosen such that, dependent on the embodiment, the upper tool part 16 may be accommodated in the first tool holder 7 or in the second tool holder 30.

Coming from the axis 29 in the same direction, the radial distance between the axis 29 and rim 28 is smaller than the radial distance between the axis 29 and the side face 23 due to the bevel 22. The distance between the axis 29 and the side face 23 is chosen circumferentially such that a first suitable clearance results between the side face 23 and the wall of the orifice 20 of the die 17 (FIG. 2). Compared to the first clearance at the end of the stamp 19, a second clearance between the bevel 22 and the orifice wall 20 decreases as the stamp moves into the die, due to the bevel 22.

In operation, the die 17 is accommodated in the first tool holder 7. The upper tool part 16 is accommodated in the second tool holder 30. Dependent on the case of application, the possibility is also alternatively given that the die is accommodated in the second tool holder 30 and that the upper tool part 16 is accommodated in the first tool holder 7. Subsequently, the sheet metal 15 is inserted between the stamp 19 and the die 17 by an appropriate device. The sheet metal 15 is positioned such that a desired orifice may be made in the sheet metal 15 at a desired location. Subsequently, the upper tool part 16 moves downwardly and the desired orifice in the sheet metal 15 is produced.

As described above, deformations of the sheet metal 15 occur due to the applied stresses.

By the enlarged second clearance between the stamp 19 and the die 17, compared to the first clearance, a bend radius of the sheet metal along the orifice to be punched increases as the sheet metal 15 is pushed in by the end face 21. During the penetration of the stamp 19 into the sheet metal 15, the sheet metal is cut by the rim 28, and then it is separated and radial forces are simultaneously applied to the sheet metal 15 by the bevel 22 having the angle α. Due to the radial forces, compressive stresses occur in the vicinity of the orifices to be punched. Therefore, a better distribution of the stress is created in the sheet metal. By balancing the stresses in the sheet metal, almost even sheet metals with punched orifices are produced. Accordingly, a method of straightening is performed effectively during punching.

Figure 4A:
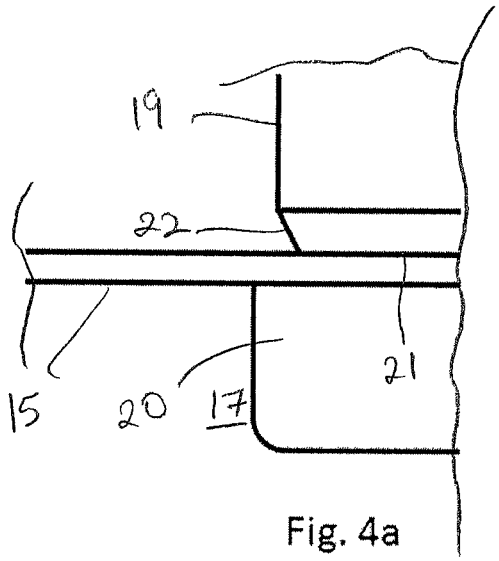
FIG. 4*a* shows a cross-sectional view of the stamp of FIG. 3*a* contacting a top surface of sheet metal.
Figure 4B:
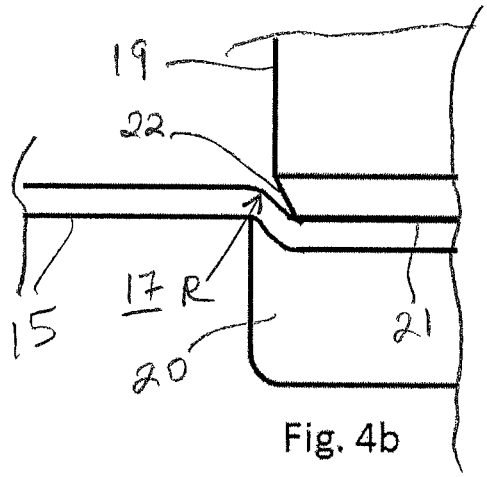
FIG. 4*b* shows a cross-sectional view of the stamp of FIG. 3*a* imprinting the top surface of the sheet metal of FIG. 4*a*.
Figure 4C:
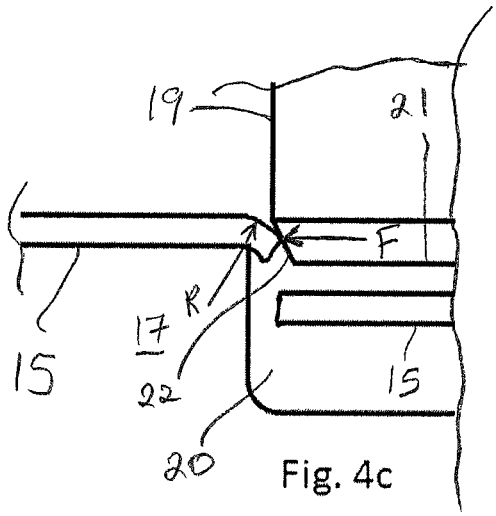
FIG. 4*c* shows a cross-sectional view of the stamp of FIG. 3*a* cutting the sheet metal of FIG. 4*a*.

FIGS. 4*a*-4*c* illustrate a method of punching a hole in sheet metal 15. Prior to performing the punching operation, the die 17 is secured to the first tool holder 7, the stamp 19 is secured to the second tool holder 30, and the sheet metal 15 is inserted between the stamp 19 and the die 17. Referring particularly to FIG. 4*a*, the stamp 19 is driven downwardly to a top surface of the sheet metal 15. As shown in FIG. 4*b*, as the stamp 19 is driven downwardly further, the end face 21 of the stamp 19 imprints the top surface of the sheet metal 15, causing a bend radius R to form in the top surface of the sheet metal 15. As shown in FIG. 4*c*, further downward movement of the stamp 19 causes the end face 21 of the stamp 19 to cut the sheet metal 15, while the bevel 22 applies radial forces F to an edge of the remaining sheet metal 15. A cut portion of the sheet metal 15 is released within the orifice 20 of the die 17.

The magnitude of the applied radial forces F may be modified by an adjustment of the stamp 19. The larger the angle α of the bevel 22, the higher the magnitude of the applied radial forces F. In the present embodiment, the angle α of the bevel 22 is 30°. Good results in view of the evenness of the sheet metal 15 are also achieved with the angle α of the bevel 22 in a range between 15° and 45°. A punching tool 14 having the angle α of the bevel 22 between 25° and 35° is alternatively more favorable.

A further parameter having some influence on the result of machining is the height H of the bevel 22. The height H of the bevel 22 results from the angle α of the bevel 22 and the distance between the axis 29 and the rim 28. The angle α of the bevel 22 is circumferentially constant. The height H of the bevel 22 is determined depending on different operation parameters. The parameters include the tensile strength of the sheet metal 15, the thickness of the sheet metal 15, the shape of the end face 21, and/or the contour of the rim 28, and therefore, the shape of the punching. In principle, the height H of the bevel 22 is increased as the thickness of the sheet metal increases. The height H of the bevel 22 may be increased as the tensile strength of the material of the sheet metal increases. Concerning the shape of the end face 21, the height H of the bevel 22 is ascertained in view of a good evenness of the sheet metal 15.

In an alternate embodiment, in addition to the use of the stamp 19 with the bevel 22, the first tool holder 7 accommodating the die 17 is moved upwardly whereby the sheet metal 15 is bent upwardly by the die 17 and deformed plastically thereby. In another alternate embodiment, the sheet metal 15 is pushed against a stripper having stiff outer regions as well as elastic inner regions. In the elastic region of the stripper, the sheet metal 15 is upwardly and plastically deformed.

A grade of punching indicates a relationship between the area of punched orifices and the area of the remaining material of the sheet metal 15 in a certain portion. The more orifices are punched or the larger the orifices are, the larger is the grade of punching in a certain portion of the sheet metal. The larger the grade of punching, the farther the die 17 should be moved upwardly in order to improve evenness of the sheet metal 15. The shape of the end face 21 also influences the distance that the die 17 is moved upwardly. By these measures, the evenness of the metal sheet may also be maintained even with grades of punching of up to about 40% to 50%.

A number of embodiments of the invention have been described. Nevertheless, it will be understood that various modifications may be made without departing from the spirit and scope of the invention. Accordingly, other embodiments are within the scope of the following claims.

What is claimed is:

1. A method of punching sheet metal in a punching machine, the method comprising:

accommodating a die in a first tool holder of the punching machine;

accommodating a stamp, complementary to the die, in a second tool holder of the punching machine, wherein the stamp comprises an end face defining a rim and a bevel extending between the end face and a side wall of the stamp;

inserting a metal sheet to be stamped between the stamp and the die;

punching the metal sheet, the punching comprising:

imprinting a surface of the metal sheet with the end face of the stamp in a first phase of a punching stroke of the second tool holder, thereby creating a bend in the metal sheet between the end face of the stamp and an adjacent edge of the die, the bend defining a bend radius, cutting the metal sheet with the rim of the end face in a second phase of the punching stroke of the second tool holder, to form a cut edge of the metal sheet that defines an orifice in the metal sheet, and applying a lateral force to the cut edge of the metal sheet with the bevel; and moving the first tool holder toward the metal sheet, such that the metal sheet is bent and thereby deformed plastically by the die, wherein a grade of punching is determined based on a ratio of an area of punched orifices in a portion of the metal sheet to an area of material remaining in the portion of the metal sheet, and wherein, during movement of the first tool holder toward the metal sheet, the first tool holder is moved toward the metal sheet by a distance determined as a function of the grade of punching, the distance increasing as the grade of punching increases.

2. The method of claim 1, wherein the distance is further determined as a function of the shape of the end face of the stamp.

3. The method of claim 1, further comprising securing the metal sheet to a clamping member of the punching machine.

4. The method of claim 3, further comprising positioning the clamping member such that the metal sheet is positioned at a desired location relative to the stamp and the die.

5. The method of claim 1, further comprising accommodating the die in the second tool holder of the punching machine.

6. The method of claim 1, further comprising accommodating the stamp in the first tool holder of the punching machine.

7. The method of claim 1, wherein the grade of punching increases as a number of the punched orifices in the portion of the metal sheet increases or as the area of the punched orifices in the portion of the metal sheet increases.

* * * * *

UNITED STATES PATENT AND TRADEMARK OFFICE

CERTIFICATE OF CORRECTION

PATENT NO. : 9,266,163 B2
APPLICATION NO. : 13/493506
DATED : February 23, 2016
INVENTOR(S) : Alexander Tatarczyk It is certified that error appears in the above-identified patent and that said Letters Patent is hereby corrected as shown below:

Title page

(75) (Inventor), delete "Seltingen-Oberflact" and insert --Seitingen-Oberflact--.

(73) (Assignee), delete "TRUMF" and insert --TRUMPF--.

Signed and Sealed this
Tenth Day of May, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,266,163 B2
APPLICATION NO. : 13/493506
DATED : February 23, 2016
INVENTOR(S) : Alexander Tatarczyk It is certified that error appears in the above-identified patent and that said Letters Patent is hereby corrected as shown below:

On the title page, item (75) (Inventor), delete "Seitingen-Oberflact" and insert --Seitingen-Oberflacht--.

Signed and Sealed this
Sixteenth Day of August, 2016

Michelle K. Lee

Michelle K. Lee
*Director of the United States Patent and Trademark Office*